United States Patent [19]

Hancock

[11] 4,091,479

[45] May 30, 1978

[54] RAIL CHAIR FOR TRANSPORTING NON-AMBULATORY PERSONS

[76] Inventor: Robert D. Hancock, 1025-33rd Ave., Longview, Wash. 98632

[21] Appl. No.: 752,115

[22] Filed: Dec. 20, 1976

[51] Int. Cl.[2] ..... A47K 3/12

[52] U.S. Cl. ..... 4/185 S; 297/344

[58] Field of Search ..... 4/134, 185 R, 185 S, 4/185 L, 254; 297/252, 344, 349; 308/238, DIG. 7, DIG. 8

[56] References Cited

U.S. PATENT DOCUMENTS

| | | | |
|---|---|---|---|
| 2,648,849 | 8/1953 | Webb et al. | 4/185 L |
| 3,113,804 | 12/1963 | Ritter | 297/252 |

*Primary Examiner*—Houston S. Bell, Jr.
*Attorney, Agent, or Firm*—Eugene D. Farley

[57] ABSTRACT

A chair assembly for transporting non-ambulatory persons, for example, to and from a tub or stall shower, comprises in combination a horizontal rail, legs on each end of the rail supporting the same, a slide on the rail, a chair seat, and pivotal mounting means rotatably mounting the seat on the slide.

10 Claims, 6 Drawing Figures

RAIL CHAIR FOR TRANSPORTING NON-AMBULATORY PERSONS

BACKGROUND AND GENERAL STATEMENT OF THE INVENTION

This invention pertains to chairs of the class used for transporting non-ambulatory persons. It pertains particularly to a chair slidable on a rail and used for transporting non-ambulatory persons into and out of a bathtub or stall shower.

In the care of non-ambulatory persons, a problem is presented in providing a bath facility which may be used without requiring the attendant to lift the person, possibly subjecting the attendant to a physical strain which he is not able to bear. It also is difficult to provide a bathing facility which enables the person to bathe himself efficiently, both fore and aft, without subjecting him to fatigue or the hazard of slipping and falling.

It is the general purpose of the present invention to provide such a facility in the form of a swiveling chair which slides on a rail and therefore may be used to transport the person into or out of the bathtub or shower stall and which when in position enables the patient to bathe himself effectively without outside help.

Another object of the present invention is the provision of a rail chair for non-ambulatory persons which is easy to use, which may be used in a variety of situations where it is desired to move the person a stated distance, as to and from a table, chair, patio, or other location; which may be used in a shower where it is wetted completely with water, without danger of corrosion or mechanical failure; which is self-lubricating without the application of grease, which will not soil or injure the person using it; and which eliminates the necessity of requiring the attendant to lift the non-ambulatory person with possible danger to both parties.

The foregoing and other objects of this invention are accomplished by the provision of a rail chair assembly comprising in combination a rail, leg means on each end of the rail for supporting the same in a substantially horizontal position, a slide on the rail, a chair seat, and pivotal mounting means rotatably mounting the seat on the slide.

The slide on the rail includes bearing means of self-lubricating plastic such as Nylon or Teflon which accordingly eliminates the necessity of applying outside lubrication. The pivotal mounting means also embodies bearings of self-lubricating plastic so it, too, is relieved of the necessity of applying external lubrication.

The legs supporting the rail, one on each end, are designed so that one leg may be placed in a location difficult of access, for example, a bathtub or shower stall, while the other leg is designed to impart stability to the assembly. The legs are provided with casters or glides which permit moving the assembly easily from place to place, either when occupied by the non-ambulatory person, or when the chair seat is empty.

DESCRIPTION OF A SPECIFIC EMBODIMENT OF THE INVENTION

Figure 1:
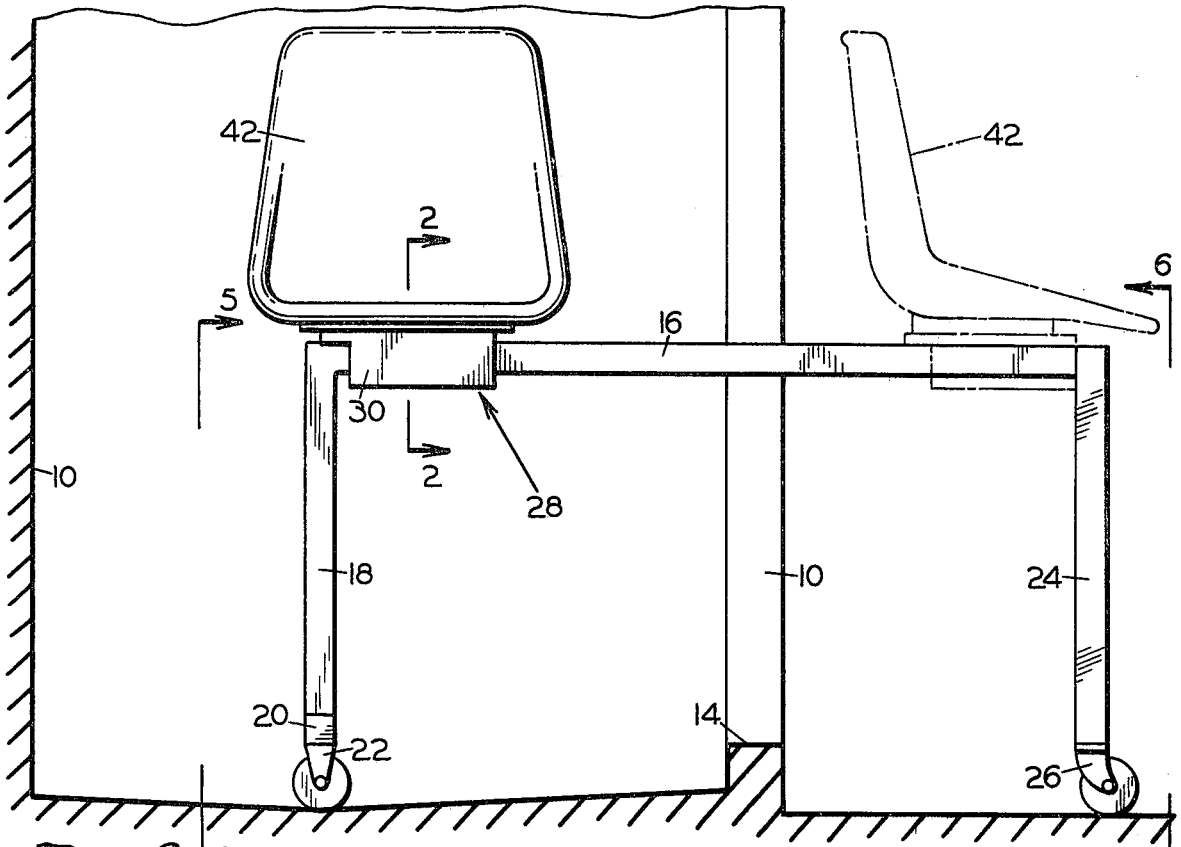
FIG. 1 is a view in side elevation of the herein described rail chair assembly.
Figure 2:
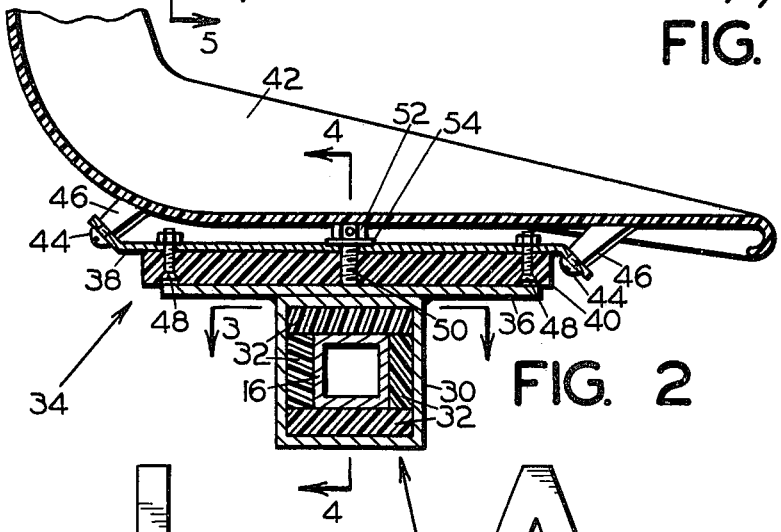
FIG. 2 is a transverse sectional view taken along line 2—2 of FIG. 1.
Figure 3:
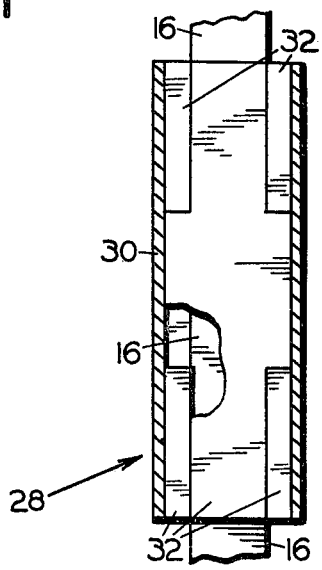
FIG. 3 is a fragmentary, detail, sectional, view taken along line 3—3 of FIG. 2.
Figure 5:
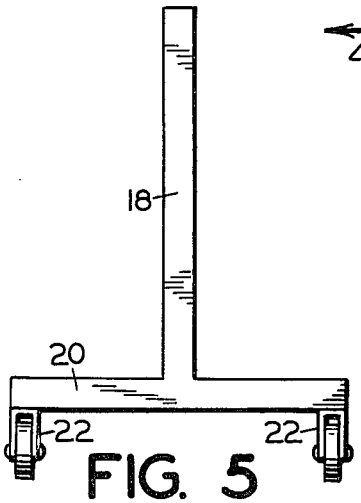
Figure 6:
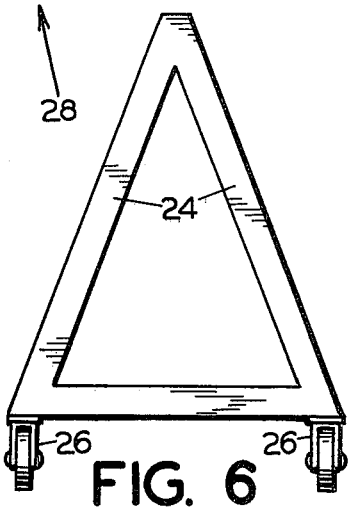
Figure 4:
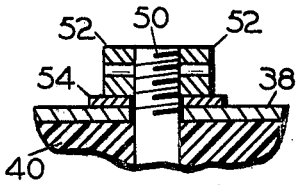

FIG. 4 is a detail, fragmentary, sectional, view taken along line 4—4 of FIG. 2; and FIGS. 5 and 6 are views in end elevation looking respectively in the direction of the arrows of lines 5—5 and 6—6 of FIG. 1.

As is illustrated in FIG. 1 the herein described rail chair is adapted for use in transporting a non-ambulatory person from one place to another place, for example, from a location outside a shower stall 10 defined in part by a front partition including a doorway 12 and a water retaining partition 14; to a location within the shower stall, as indicated by the dashed and full line positions of the chair seat included in the chair assembly.

The chair assembly is supported on a rail 16 which in turn is supported on legs integrated one with each end of the rail.

The legs on the forward end of the rail are adapted for positioning in a location difficult of access, as for example, in a shower stall or bathtub.

As shown particularly in FIG. 5, the forward legs comprise a vertical post 18, the upper end of which is attached to the rail substantially normal thereto. The lower end of the post mounts a cross bar 20 arranged at right angles both to the post and to the axis of the rail.

Cross bar 20 mounts at each end an anti-friction device such as a glide, or preferably a caster, indicated at 22 in the embodiment illustrated. These casters are fixed with reference to cross bar 20.

The legs on the opposite end of rail 16 comprise a triangular frame arranged with its apex upwardly and its plane substantially normal to the axis of rail 16. Anti-friction devices such as glides or casters 26 are mounted one on each of the lower corners of the triangular frame. In the embodiment illustrated, these casters swivel with respect to the frame in which they are mounted to facilitate positioning the rail in any desired location.

A slide is mounted on the rail for sliding movement from one end to the other. It is indicated generally at 28.

As indicated particularly in FIG. 2, the slide comprises a case 30 which encloses the rail. Like the rail, it is of rectangular cross section to prevent the chair from twisting relative to the rail.

Case 30 is spaced from the rail, with the space being packed with plates 32 of Nylon, Teflon, or other self-lubricating plastic. In addition to being self-lubricating, such plastics are hard and strong so that they withstand the load supplied to them as the slide moves along the rail.

The pivotal mounting means supported on slide 28 is indicated generally at 34.

It comprises a lower plate 36, a vertically spaced upper plate 38, as shown in FIG. 2, and an interposed bearing plate 40.

Lower plate 36 is welded or otherwise fixed centrally to the upper surface of case 30.

Upper plate 38 is removably fixed to chair seat 42 by means of bolts 44 and internally threaded posts 46, integral with the chair seat.

Bearing plate 40, like bearing pads 32, is made of a self-lubricating plastic such as Nylon or Teflon. It is fixed to one of the plates, for example, upper plate 38 by means of bolts 48, the heads of which are recessed into the plastic to present a planar plastic surface to the exterior. This surface is in bearing engagement with plate 36.

A pivot post 50 is welded centrally to the upper surface of plate 36. It extends upwardly, penetrating central openings through plastic plate 40 and upper plate 38 in bearing relation thereto. Its upper end is threaded to receive a nut 52 and washer 54 by means of which the pivotal chair assembly is secured to lower plate 36.

The use of my rail chair assembly is illustrated in FIG. 1.

First, the assembly is located with the forward legs including post 18, placed in the desired location, for example in a shower stall or in a bathtub. The outer legs then are placed in a selected location outside the shower stall or beside the bathtub where they stabilize the assembly.

Chair 42 is moved to its dashed line position. The non-ambulatory patient is seated in the chair which then is slid to it full line position within the shower stall or above the bathtub.

In this position, the patient is able to bathe himself, turning the chair as desirable or necessary to enjoy a complete bath.

When the bath is finished, the procedure is reversed.

It is to be noted especially that the entire assembly is well adapted to this use in that the elements of the rail, legs, slide, swivel and chair all may be made of non-corrodible materials such as sheet aluminum or stainless steel and hence are not affected by exposure to water. The same virtue is characteristic of the plastic blocks which constitute the bearing surfaces. Furthermore, such plastic blocks are self-lubricating so that they require no maintenance and eliminate the danger of soiling the person using the chair assembly with grease or other lubricants.

In addition, the chair may be used effectively in a great diversity of situations and with complete safety to both the patient and the attendant.

Having thus described my invention in preferred embodiments, I claim:

1. A chair assembly for transporting non-ambulatory persons comprising in combination:

a. an elongated rail of non-circular cross section, b. leg means on each end of the rail for supporting the same in substantially horizontal position, c. a slide on the rail comprising a hollow case of non-circular cross section enclosing the rail and spaced therefrom, and bearing plates of self-lubricating plastic interposed between the case and the rail in bearing engagement with the rail, d. a chair seat, and e. pivotal mounting means interengaging the seat and case for rotatably mounting the seat on the slide.

2. The chair assembly of claim 1 wherein the leg means on one end of the rail comprises a vertical post, a horizontal bar on the bottom of the post arranged substantially normal to the axis of the rail, and a pair of anti-friction devices one on each end of the bar.

3. The chair assembly of claim 1 wherein the leg means on one end of the rail comprises a triangular frame arranged with its apex at the top and with its plane substantially normal to the axis of the rail and a pair of anti-friction devices one on each of the lower corners of the triangular frame.

4. The chair assembly of claim 1 wherein the leg means on one end of the rail comprises a vertical post, a horizontal bar on the bottom end of the post arranged substantially normal to the axis of the rail, and a pair of anti-friction devices one on each end of the bar; and wherein the leg means on the other end of the rail comprises a triangular frame arranged with the apex on the top and with its plane substantially normal to the axis of the rail, and a pair of anti-friction devices one on each lower corner of the triangular frame.

5. The chair assembly of claim 4 wherein the anti-friction devices comprise casters.

6. The chair assembly of claim 1 wherein the pivotal mounting means comprises a pair of vertically spaced plates, first fastening means fastening the lower plate to the slide, second fastening means fastening the upper plate to the chair seat, a bearing plate of self-lubricating plastic secured to one of the plates and in bearing contact with the other, and a pivot post secured centrally to one of the plates and penetrating the other in bearing relationship thereto.

7. A chair assembly for transporting non-ambulatory persons comprising in combination:

a. an elongated rail of non-circular cross section, b. first leg means on one end of the rail and comprising a vertical post, a horizontal bar on the bottom end of the post and a pair of casters one on each end of the bar, c. second leg means on the other end of the rail and comprising a triangular frame arranged with its apex pointed upwardly and its plane substantially normal to the axis of the rail, and a pair of casters one on each lower corner of the triangular frame, d. a slide on the rail comprising a hollow case of non-circular cross section enclosing the rail and spaced therefrom, and bearing plates of self-lubricating plastic interposed between the case and the rail in bearing engagement with the rail, e. a chair seat, and f. pivotal mounting means interengaging the seat and case for rotatably mounting the seat on the slide and comprising a lower plate fastened to the slide, an upper plate fastened to the seat, a bearing plate of self-lubricating plastic secured to the upper plate in bearing contact with the lower plate, and a pivot post secured centrally to the upper surface of the lower plate and penetrating the bearing plate and upper plate in bearing engagement therewith.

8. The chair of claim 7 wherein the self-lubricating plastic comprises Nylon or Teflon.

9. The chair of claim 7 wherein the self-lubricating plastic is Nylon.

10. The chair of claim 7 wherein the self-lubricating plastic is Teflon.

* * * * *